US005677704A

United States Patent [19]

Kusano et al.

[11] Patent Number: 5,677,704

[45] Date of Patent: Oct. 14, 1997

[54] DISPLAY DEVICE DRIVING METHOD

[75] Inventors: Masanori Kusano; Masaki Oie, both of Sagamihara; Eisuke Kanzaki, Fujisawa, all of Japan

[73] Assignee: International Business Machines Corporation, Armonk, N.Y.

[21] Appl. No.: 697,659

[22] Filed: Aug. 28, 1996

Related U.S. Application Data

[63] Continuation of Ser. No. 312,583, Sep. 27, 1994, abandoned.

[30] Foreign Application Priority Data

Sep. 30, 1993 [JP] Japan ..... 5-244646

[51] Int. Cl.[6] ..... G09G 3/36

[52] U.S. Cl. ..... 345/89; 345/147; 345/202

[58] Field of Search ..... 345/202, 150, 345/153, 154, 155, 147, 148, 132, 127, 129, 89, 87; 382/274, 237

[56] References Cited

U.S. PATENT DOCUMENTS 4,921,334 5/1990 Akodes ..... 345/89

5,313,196 5/1994 Tanaka et al. ..... 345/147

5,424,755 6/1995 Lucas et al. ..... 345/153

*Primary Examiner*—Xiao Wu

*Attorney, Agent, or Firm*—Ronald L. Drumheller

[57] ABSTRACT

Frame rate modulation is effected in which image data, which expresses a density of one dot by 4-bit dot data, is converted into a plurality of frame data, which express a density of one dot by 3 bits, so that the plurality of the frame data are sequentially displayed on the LCD. In the above conversion, the high order 3 bits of the dot data are extracted and made into data of one dot of each frame. In a case in which the least significant bit of the first dot data is 1 and the most significant bit is 0, 1 is added to a corresponding portion of the respective frame data. In a case in which the least significant bit of the dot data is 0 and the most significant bit is 1, 1 is subtracted from a corresponding portion of the respective frame data. In accordance with the above description, the image data is converted into the frame data as shown in Table 2, and the sum (apparent densities) of the plurality of converted frame data always changes in accordance with the changes in the dot data.

4 Claims, 5 Drawing Sheets

DISPLAY DEVICE DRIVING METHOD

This is a continuation of application Ser. No. 08/312,583, filed Sep. 27, 1994, now abandoned.

BACKGROUND OF THE INVENTION

1. Field of the Invention

The present invention relates to a display device driving method, and more particularly to a display device driving method in which image data is converted into a plurality of frame data, so as to drive a display device such as a liquid crystal display or the like by the plurality of frame data.

2. Related Art

In an information processing apparatus such as a personal computer, a flat panel-shaped display device, such as a plasma display or a liquid crystal display, is conventionally known as a display device for displaying an image such as characters or graphics. Such a display device displays an image by changing, in accordance with inputted image data, respective densities of a plurality of dots which are disposed in matrix form. Color liquid crystal displays, which can generate respective colors of red(R), green(G) and blue(B), have become more widely used.

In a liquid crystal display, for example, respective densities of the dots (i.e., the optical reflection rate and the light transmission rate thereof) are changed by controlling angles of liquid molecules. The angles of the liquid molecules must be accurately controlled so as to continuously change the respective densities of the dots or to change the respective densities of the dots in grades (i.e., by multiple gradations) with small density differences. As a result, the liquid crystal display becomes rather expensive. In an ordinary liquid crystal display (hereinafter, "LCD"), the number of expressible gradations is often decreased, and respective densities of the dots can be changed into, for example, 8 grades (the number of gradations is 8). In a case in which the number of gradations is eight, 512 ($512=8^3$) colors can be expressed in a color LCD. In addition, respective densities of the dots can be expressed by 3-bit ($8=2^3$) data.

Image data is processed by an information processing apparatus and is inputted to a driver for driving an LCD. A bit length of each dot of image data is often longer (i.e., the number of gradations is larger) than the bit length for expressing the density of the dot in the previously-described LCD. The LCD driver typically uses data, from which an extra bit (a least significant bit) of the inputted image data is removed, to drive the LCD and to display the image. In this case, there is a drawback in that the image data, which has many gradations and is inputted from the information processing apparatus, is not effectively used.

To solve this drawback, a group of frame data having a plurality of continuous frames is defined as one unit so that each group of frame data corresponds to a different image on the LCD. The LCD can display an image at a predetermined frame rate (e.g., 60 Hz). Then, frame rate modulation is effected for the respective frame data forming the group of frames so as to change the respective densities of the dots. As a result, an image whose number of gradations is apparently large is displayed. Table 1 shows an example of converting image data into frame data having a plurality of frames by frame rate modulation. Here, image data, which expresses the density of one dot in 4 bits (the number of gradations is 16), is converted into frame data of 3 frames (a first through a third frame), which expresses the density of one dot in 3 bits (the number of gradations is 8).

TABLE 1

| image data | frame date (binary) | | |
|---|---|---|---|
| (binary) | first frame | second frame | third frame |
| 0000 | 000 | 000 | 000 |
| 0001 | 001 (+1) | 001 (+1) | 000 |
| 0010 | 001 | 001 | 001 |
| 0011 | 010 (+1) | 010 (+1) | 001 |
| 0100 | 010 | 010 | 010 |
| 0101 | 011 (+1) | 011 (+1) | 010 |
| 0110 | 011 | 011 | 011 |
| 0111 | 100 (+1) | 100 (+1) | 011 |
| 1000 | 100 | 100 | 100 |
| 1001 | 101 (+1) | 100 | 100 |
| 1010 | 101 | 101 | 101 |
| 1011 | 110 (+1) | 101 | 101 |
| 1100 | 110 | 110 | 110 |
| 1101 | 111 (+1) | 110 | 110 |
| 1110 | 111 | 111 | 111 |
| 1111 | 111 | 111 | 111 |

According to the above table, the high order three bits of a 4-bit image data are the data of the respective frames. In a case in which a most significant bit is 0 and a least significant bit is 1, 1 is added to data of the first frame and the second frame so as to convert the image data into three frame data. In a case In which the most significant bit is 1 and the least significant bit is 1 (except for $(1111)_2$, "$(\ )_2$" denoting a binary number), 1 is added only to data of the first frame so as to convert the image data into three frame data. The images of the first through third frames are sequentially displayed on the LCD. Consequently, the images, in which respective densities of the dots are apparently expressed in 16 gradations, can be displayed on the LCD.

However, according to Table 1, data values of the respective frames are the same in a case in which the image data is $(1110)_2$ and a case in which the image data is $(1111)_2$. Accordingly, densities are not different between dots corresponding to the data $(1110)_2$ and dots corresponding to the data $(1111)_2$. There is a drawback in that, in practice, the respective densities of dots can be expressed in only 15 gradations and an image which accurately expresses the image which is represented by the inputted image data cannot be displayed.

SUMMARY OF THE INVENTION

In view of the facts set forth above, it is an object of the present invention to provide a display device driving method in which an image can be displayed so as to accurately express the image which is represented by the image data, even if the display device can only display a small number of gradations.

To accomplish the above-described purpose, a display device driving method relating to the present invention is characterized in that image data, which expresses respective densities of dots by first dot data of a predetermined bit length, is converted into a plurality of frame data, which expresses respective densities of dots by second dot data which is shorter than said predetermined bit length, so as to drive a display device by said plurality of frame data, said display device driving method characterized by converting image data into a plurality of frame data by making data, from which a least significant bit of said first dot data has been removed, into said respective second dot data of said plurality of frame data, and in a case in which the least significant bit of said first dot data is 1 and a most significant bit is 0, adding 1 to a corresponding portion of said plurality of second dot data, and in a case in which the least significant bit of said first dot data is 0 and the most significant bit is 1, subtracting 1 from a corresponding portion of said plurality of second dot data.

In the invention described in Claim 1, it is preferable that in a case in which a difference between one of said first dot data and a first dot data whose most significant bit of said first dot data is 1 and the other bits are 0 is small, a number of second dot data for which said addition or said subtraction is effected is decreased, and in a case in which said difference is large, the number of second dot data for which said addition or said subtraction is effected is increased.

In the invention described in Claim 1, a liquid-crystal display at which a thin-film transistor is provided in correspondence with respective dots is used as said display device.

In the invention described in Claim 3, it is preferable that image data is converted into three frame data.

Dot data expresses respective densities of dots of image data. Conventionally, data, from which a least significant bit of the dot data has been removed, is made into data of respective frames, and only addition is effected for a portion of data of the respective frames in accordance with the least significant bit. Here, data of the respective frames are the same in a case in which all bits of the previously-described dot data are 1 and a case in which the least significant bit of the dot data is 0 and all of the other bits are 1. Similarly, data, from which a least significant bit of the dot data of the image data has been removed, is made into data of the respective frames, and only subtraction is effected for a portion of data of the respective frames in accordance with the least significant bit. Here, data of the respective frames are the same in a case in which all bits of the previously-described dot data are 0 and a case in which the least significant bit of the dot data is 1 and all of the other bits are 0.

In the present invention, data, from which a least significant bit of the first dot data of the image data has been removed, is made into the respective second dot data of the plurality of frame data. In a case in which the least significant bit of the first dot data is 1 and the most significant bit is 0, 1 is added to a corresponding portion of the plurality of second dot data so as to convert the image data into the plurality of frame data. In a case in which the least significant bit of the first dot data is 0 and the most significant bit is 1, 1 is subtracted from a corresponding portion of the plurality of second dot data so as to convert the image data into the plurality of frame data.

Accordingly, in a case in which all bits of the first dot data are 1, neither addition nor subtraction is effected for the second dot data so that all of the bits of the plurality of second dot data are 1. In a case in which the least significant bit of the first dot data is 0 and all of the other bits are 1, 1 is subtracted from a portion of the plurality of second dot data since the most significant bit of the first dot data is 1. Therefore, portions of the plurality of second dot data are different in the case in which all of the bits of the first dot data are 1 and the case in which the least significant bit of the first dot data is 0 and all of the other bits are 1.

Moreover, in a case in which all of the bits of the first dot data are 0, neither addition nor subtraction is effected for the second dot data so that all of the bits of the plurality of second dot data are 0. In a case in which the least significant bit of the first dot data is 1 and all of the other bits are 0, 1 is added to a portion of the plurality of second dot data since the most significant bit of the first dot data is 0. Therefore, portions of the plurality of second dot data are different in the case in which all of the bits of the first dot data are 0 and the case in which the least significant bit of the first dot data is 1 and all of the other bits are 0.

According to the present invention, the portions of the plurality of second dot data can always change in accordance with the changes in the first dot data. A plurality of frame data, which are obtained as described above, are used, and the display device is driven so that images, which are expressed by the respective frame data, are sequentially displayed on the display device. In this case, even if the display device is inexpensive and can express only a small number of gradations, the densities of the respective dots can be expressed by a number of gradations apparently similar to the number of gradations which is expressed by the image data. Accordingly, the image can be displayed so as to precisely express the image which is represented by the image data.

According to the present invention, 1 is added to the second dot data in a case in which the least significant bit of the first dot data is 1 and the most significant bit is 0, and 1 is subtracted from the second dot data in a case in which the least significant bit of the first dot data is 0 and the most significant bit is 1. In a case in which the number of the second dot data to which 1 is added and the number of the second dot data from which 1 is subtracted are constant, when the image data is within the range of $(0110)_2$ to $(1001)_2$, which is a borderline region in the present invention between whether addition should be effected or whether subtraction should be effected, it suffices that the plurality of second dot data does not change in accordance with the changes in the first dot data. Or, the sum of the plurality of second dot data may change in the opposite direction (for example, the sum of the second dot data decreases while the value of the first dot data increases).

As described in Claim 2, in a case in which a difference between one of the first dot data and a first dot data whose most significant bit of the first dot data is 1 and the other bits are 0 is small, it is preferable to decrease the number of the second dot data for which addition or subtraction is effected, and in a case in which the difference is large, it is preferable to increase the number of the second dot data for which addition or subtraction is effected. Since the sum of the second dot data can always change in the same direction as the changes in the first dot data, densities of the respective dots can be expressed by the number of gradations apparently similar to the number of gradations which is expressed by the image data.

As described in Claim 3, it is preferable to convert image data into three frame data when a liquid crystal display, at which a thin film transistor (i.e., TFT) is provided in correspondence with respective dots, is used as a display device. Inventors of the present invention have confirmed by experimentation that an appropriate number of frames to prevent flickering of the image displayed on the display device is three or less. The liquid crystal display with the TFT is also suitable for displaying a dynamic image, which Is vivid and moves quickly. However, if frame rate modulation is effected in a case in which the number of frames in one cycle (the cycle during which one image is displayed) is even there is a drawback in that a direct-current component remains in the voltage for driving the liquid crystal display. Thus, it is not preferable to form one cycle with two frames. As described above, if the display device is driven so as to convert image data into three frame data, wherein one cycle is formed by three frames, there is no problem of flickering, and the direct-current component can be prevented from remaining in the driving voltage.

DESCRIPTION OF THE PREFERRED EMBODIMENTS

Figure 1:
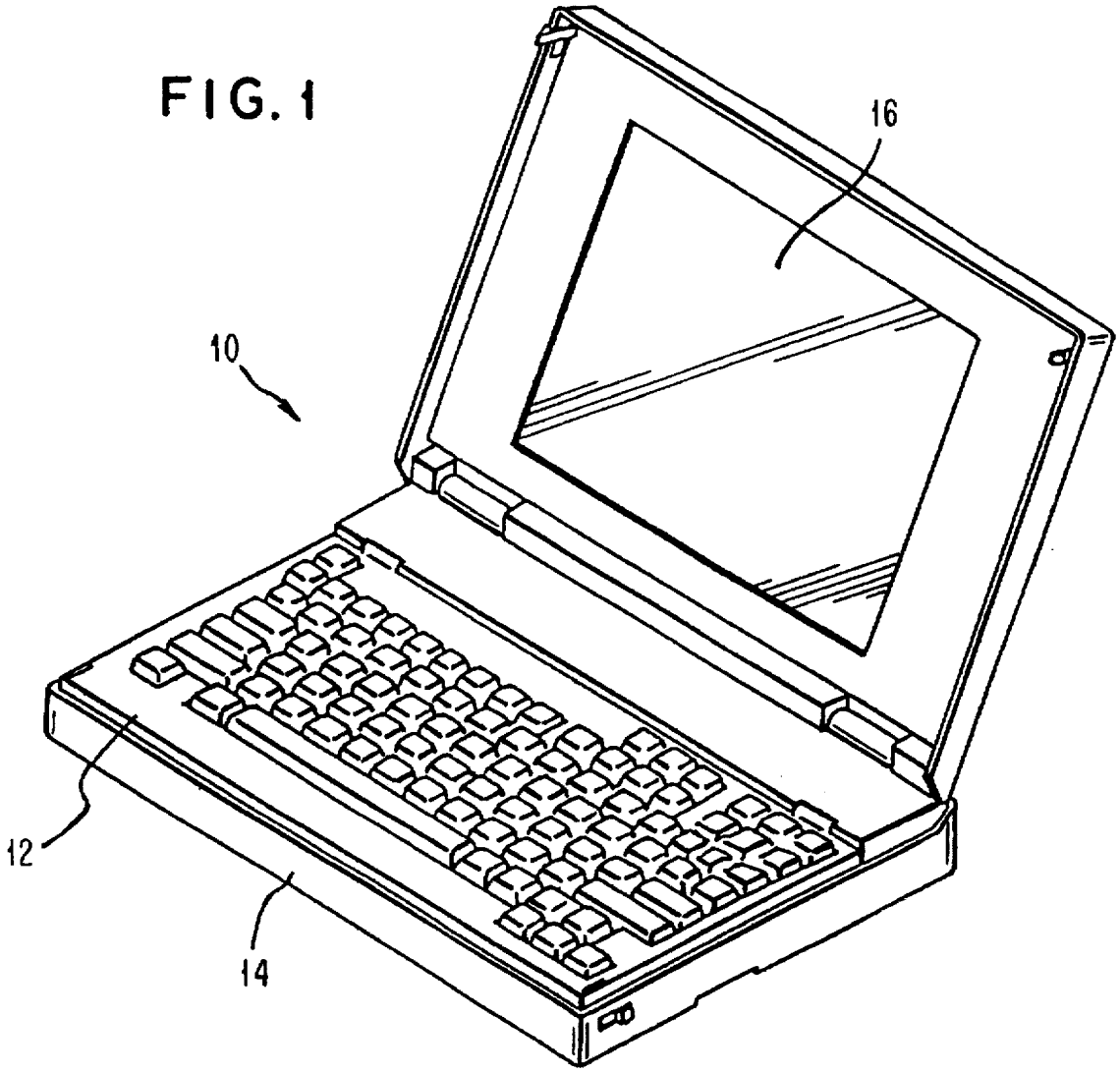
FIG. 1 is a perspective view showing an exterior of a personal computer to which the present invention is applicable.

An embodiment of the present invention will be described hereinafter with reference to the drawings. FIG. 1 shows a laptop computer 10 to which the present invention is applicable.

The laptop computer 10 includes a keyboard 12 for inputting data or the like, a computer main body 14 for performing various processes and a color liquid crystal display 16 (hereinafter, "LCD 16") for displaying a color image which includes the processing results of the computer main body 14. The laptop computer 10 also includes an input/output device (not shown) for accepting and passing on data, commands or the like from and to other devices. The LCD 16 includes a so-called TFT-type color liquid crystal display (not shown), in which a thin film transistor is provided for dots of three colors, red(R), green(G) and blue(B), which constitute a pixel.

Figure 2:
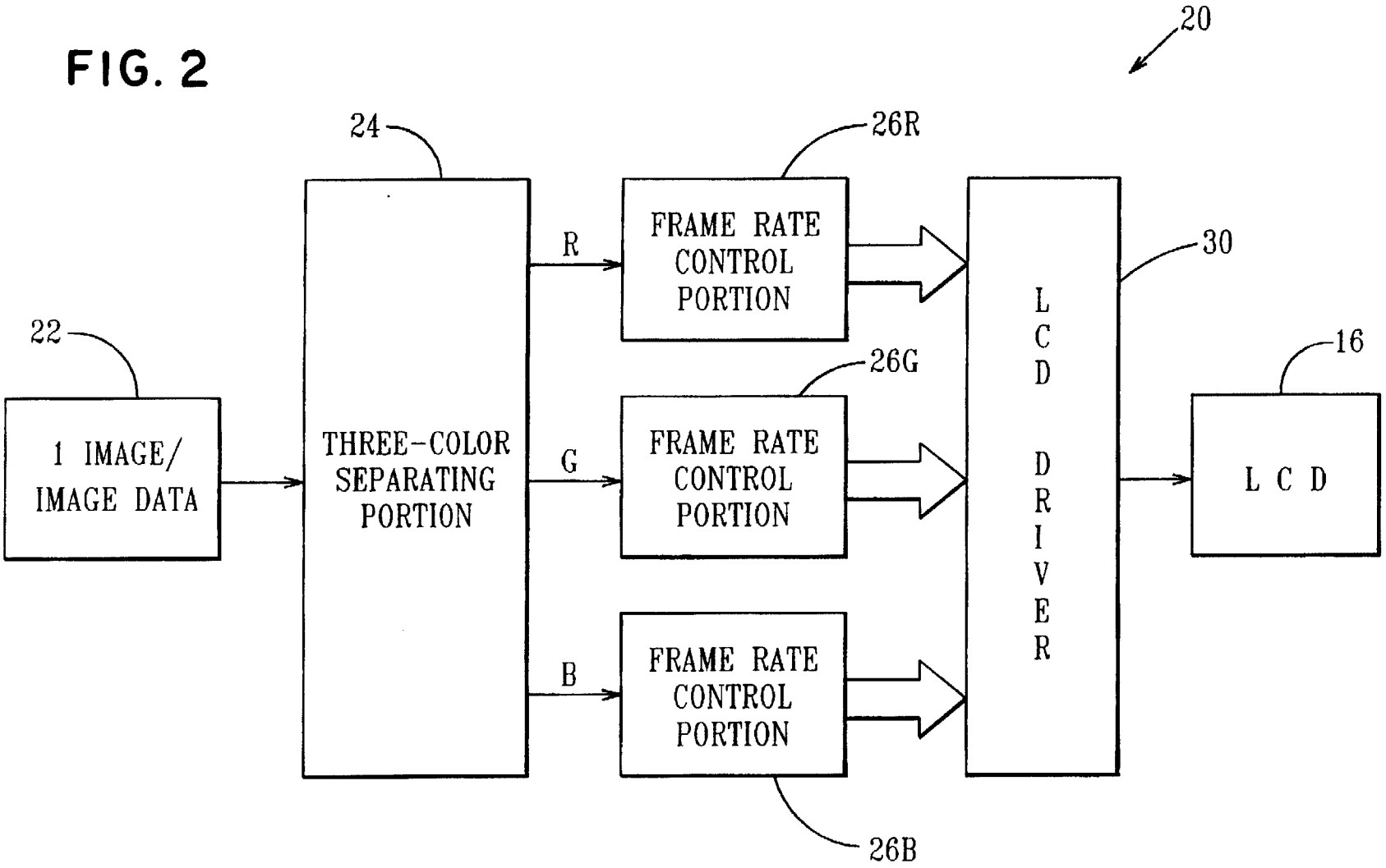
FIG. 2 is a block diagram showing a structure a schematic structure of an LCD driving unit.

An LCD driving unit 20 within the computer main body 14 is structured as shown in FIG. 2. Namely, the LCD driving unit 20 includes a buffer 22 for temporarily storing color image data which is outputted from an unillustrated microprocessor within the computer main body 14. In the present embodiment, image data, which expresses in 8-bits the respective densities of dots of three colors R, G and B which form a pixel, are inputted from the microprocessor to the LCD driving unit 20. An output end of the buffer 22 is connected to an input end of a three-color separating portion 24. The three-color separating portion 24 separates the color image data, which is temporarily stored in the buffer 22, into R, G and B. The three-color separating portion 24 extracts the most significant 4 bits from the 8-bit data which expresses respective densities of the dots, and, thereafter, outputs, as a predetermined bit length, R image data, G image data and B image data which express the respective densities of the dots by 4-bit dot data. Note that the image data of the respective colors correspond to the image data of the present invention.

Frame rate control portions 26R, 26G and 26B are connected to respective output ends of the three-color separating portion 24. The R image data, the G image data and the B image data are inputted to the frame rate control portions 26R, 26G and 26B, respectively. The same image data is inputted from the three-color separating portion 24 three consecutive times, and the respective frame rate control portions 26R, 26G and 26B perform frame rate modulation for the inputted image data with one cycle being three frames. The frame rate modulation will be described later. The respective frame rate control portions 26R, 26G and 26B output different frame data (any one of the frame data of the first through third frames corresponding to a single image data) each time as a frame data for each color.

Output ends of the frame rate control portions 26R, 26G and 26B are respectively connected to an LCD driver 30. The LCD driver 30 is connected to the LCD 16. The LCD driver 30 uses the inputted frame data for respective colors so as to turn on and off the thin film transistor of the LCD 16 and display a color image on the LCD 16.

Next, the structure of the frame rate control portion will be explained. Since the structures of the respective frame rate control portions 26R, 26G and 26B are the same, a description will be given hereinafter of the structure of the frame rate control portion 26R with reference to FIG. 3. The frame rate control portion 26R includes four signal lines 30A, 30B, 30C and 30D. Ends of the signal lines 30A, 30B, 30C and 30D are respectively connected to unillustrated input ends of the frame rate control portion 26R. The image data are inputted, in parallel, to the respective signal lines in dot data unit (4-bit): a first bit (the most significant bit, denoted by (4) in FIG. 3) data of the 4-bit image data is inputted to the signal line 30A; a second bit (denoted by (3) in FIG. 3) data is inputted to the signal line 30B; a third bit (denoted by (2) In FIG. 3) data is inputted to the signal line 30C; and a fourth bit (the least significant bit, denoted by (1) in FIG. 3) data is inputted to the signal line 30D.

Others of ends of the signal lines 30A, 30B and 30C are connected to respective ones of the two input ends (i.e., are connected to input ends A3, A2 and A1) of a 3-bit adder 32. Further, the signal lines 30A through 30D are respectively connected to input ends of a decoder 34. In a case in which the 4-bit image data, which is inputted via the signal lines 30A through 30D, is within the range of $(0110)_2$ to $(1001)_2$, the decoder 34 outputs a high-level signal. In a case in which the value of the 4-bit image data is outside the previously-described range, the decoder 34 outputs a low-level signal. The decoder 34 is connected to a control signal input end of a multiplexer 36.

Figure 4:
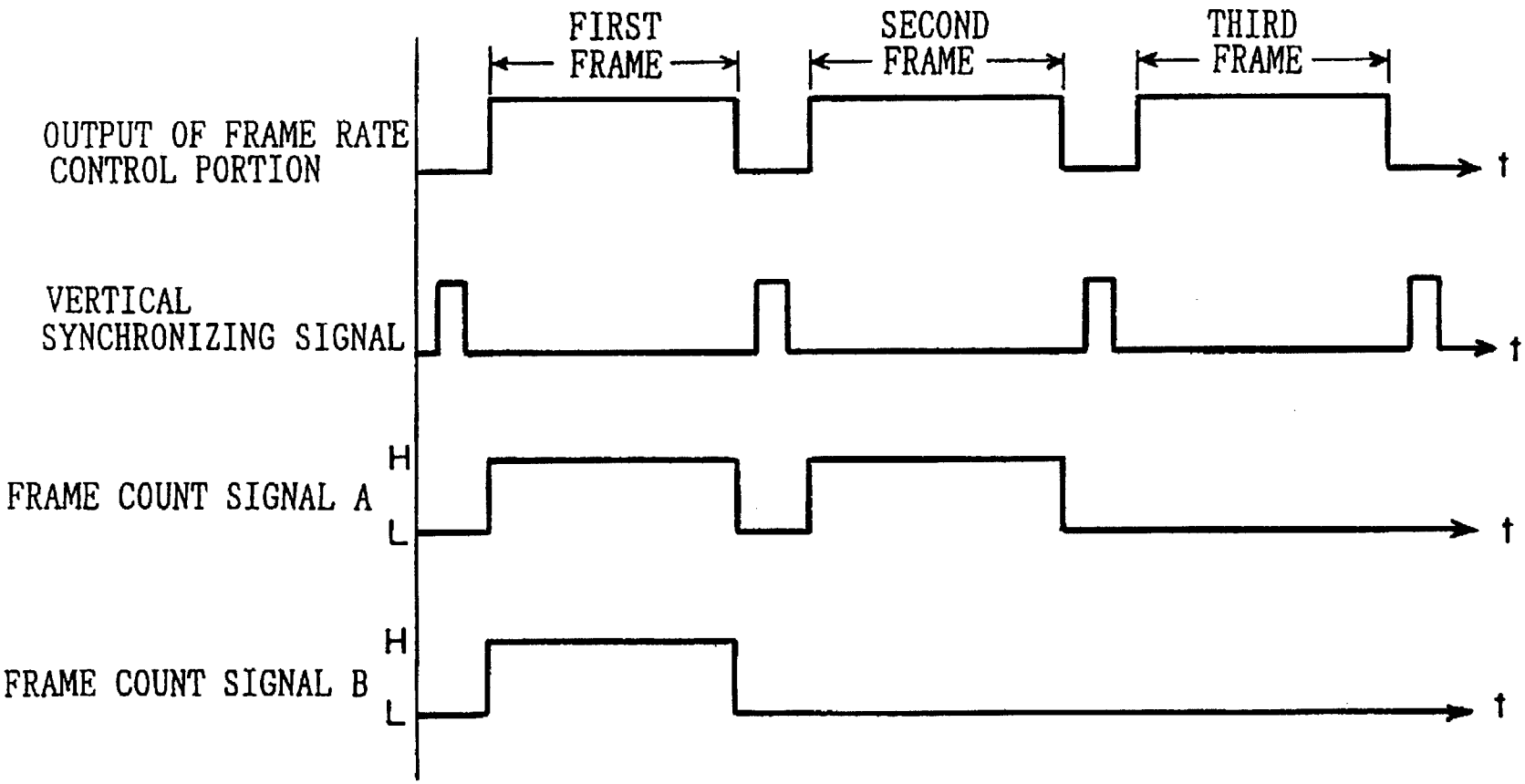
FIG. 4 is a timing chart illustrating frame count signals.

An unillustrated signal generating portion is connected to two input ends of the multiplexer 36, and a frame count signal A and a frame count signal B are inputted from the signal generating portion. The frame count signals A and B are generated at the signal generating portion, and are based on the values obtained by counting pulses of a vertical synchronizing signal (see FIG. 4) outputted from the LCD driver 30. When the frame data of the first frame is outputted from the frame rate control portion 26R, the frame count signals A and B are both high. When the frame data of the second frame is outputted, only the frame count signal A is high. When the frame data of the third frame is outputted, the frame count signals A and B are both low (see FIG. 4).

The multiplexer 36 includes a single output end. When the signal which is inputted from the decoder 34 via the control signal input end of the multiplexer 36 is low, the multiplexer 36 outputs the frame count signal A. When the above-described signal is high, the multiplexer 36 outputs the frame count signal B. The output end of the multiplexer 36 is connected to respective ones of input ends of AND circuits 38 and 40, which are respectively provided with three input ends. One of the two remaining input ends of the AND circuit 38 is connected to the signal line 30A, and the other is connected to the signal line 30D via a NOT circuit 42. Also, one of the two remaining input ends of the AND circuit 40 is connected to the signal line 30A via a NOT circuit 44, and the other is connected to the signal line 30D.

Output ends of the AND circuit 38 are connected to respective other ones of the two input ends (i.e., are connected to input ends B3 through B1) of the adder 32. In addition, an output end of the AND circuit 40 is connected to a carry input end of the adder 32. 3-bit output ends C3 through C1 of the adder 32 are connected to the aforementioned LCD driver 28. The adder 32 outputs via the output ends C3 through C1 the sum of 3-bit data inputted from the input ends A3 through A1 and 3-bit data inputted from the input ends B3 through B1. Moreover, in a case in which the signal which is inputted via the carry input end is high, the adder 32 outputs a result by adding "1" as in the case in which a digit is carried.

Next, operation of the present embodiment will be explained. When an image is displayed on the LCD 16, the color image data are inputted from the microprocessor within the computer main body 14 to the LCD driving unit 20 at predetermined times. The image data are temporarily stored in the buffer 22 and, thereafter, are separated into three colors at the three-color separating portion 24. Three color dots, which form a pixel, become image data for each color which are expressed in 4-bits. The image data are sequentially inputted to the frame rate control portions 26R, 26G and 26B for every dot data (every 4-bits).

The same image data from the three-color separating portion 24 is inputted three times to the respective frame rate control portions 26R, 26G and 26B. In the respective frame rate control portions 26R, 26G and 26B, first, the frame data of the first frame are sequentially outputted for every dot data (3-bit) which expresses the density of one dot. Second, the frame data of the second frame are sequentially outputted for every dot data which also expresses the density of one dot. Third, the frame data of the third frame are sequentially outputted for every dot data which again expresses the density of one dot. Accordingly, images of the first through third frames are sequentially displayed on the LCD 16.

Next, operation of the frame rate control portion will be described. The high order three bits of the 4-bit image data, which are inputted to the frame rate control portion and express the density of one dot, are inputted to the input ends A3 through A1 of the adder 32. In addition, in a case in which the 4-bit image data is within the range of $(0110)_2$ to $(1001)_2$, the decoder 34 outputs a high-level signal. Otherwise, the decoder 34 outputs a low-level signal. Consequently, while the first frame of the frame data is outputted from the frame rate control portion 26, an output signal from the multiplexer 86 Is always high. While the second frame of the frame data is outputted, the output signal is high only when the value of the inputted 4-bit image data is outside of the range of $(0110)_2$ to $(1001)_2$. While the third frame of the frame data is outputted, the output signal is always low.

On the other hand, the output signal from the AND circuit 40 becomes high in a case in which the value of the most significant bit of the 4-bit image data is "0", the value of the least significant bit is "1", and the input signal from the multiplexer 36 is high. When the output signal from the AND circuit 40 becomes high, "1" is added to the data from which the high order three bits of the 4-bit image data are extracted, and thereafter, the added data is outputted from the adder 32.

Further, the output signal from the AND circuit 38 becomes high in a case in which the value of the most significant bit of the 4-bit image data is "1", the value of the least significant bit is "0", and the input signal from the multiplexer 36 is high. When the output signal from the AND circuit 38 becomes high, three bit data, $(111)_2$, is inputted to the adder 32, "1" is subtracted from the data from which the high order three bits of the 4-bit image data are extracted, and thereafter, the subtracted data is outputted from the adder 32.

In a case in which any output signal from the AND circuits 38 and 40 is low, the high order three bits of the dot data, which are inputted to the frame rate control portion 26, are outputted as they are.

Table 2 below shows a relationship between the 4-bit image data (the first dot data) which are inputted to the frame rate control portion 26 and the 3-bit frame data (the second dot data) which are outputted from the frame rate control portion 26 by the above-described operation.

TABLE 2

| image data | frame data (binary) | | |
|---|---|---|---|
| (binary) | first frame | second frame | third frame |
| 0000 | 000 | 000 | 000 |
| 0001 | 001 (+1) | 001 (+1) | 000 |
| 0010 | 001 | 001 | 001 |
| 0011 | 010 (+1) | 010 (+1) | 001 |
| 0100 | 010 | 010 | 010 |
| 0101 | 011 (+1) | 011 (+1) | 010 |
| 0110 | 011 | 011 | 011 |
| 0111 | 100 (+1) | 011 | 011 |
| 1000 | 011 (−1) | 100 | 100 |
| 1001 | 100 | 100 | 100 |
| 1010 | 100 (−1) | 100 (−1) | 101 |
| 1011 | 101 | 101 | 101 |
| 1100 | 101 (−1) | 101 (−1) | 110 |
| 1101 | 110 | 110 | 110 |
| 1110 | 110 (−1) | 110 (−1) | 111 |
| 1111 | 111 | 111 | 111 |

In Table 2, "(+1)" denotes that the output signal from the AND circuit 40 is high, "1" is added to the data from which the high order three bits of the 4-bit image data are extracted, and thereafter, the added data is outputted. "(−1)" denotes that the output signal from the AND circuit 38 is high, "1" is subtracted from the data from which the high order three bits of the image data are extracted, and thereafter, the subtracted data is outputted.

It is clear from Table 2 that in a case in which the image data is $(1111)_2$, neither addition nor subtraction is effected, and $(111)_2$ is outputted as respective data of the first through third frames. In a case in which the least significant bit of the image data is 0 and all of the other bits are 1, i.e., $(1110)_2$, "1" is subtracted from the data from which the high order three bits of the image data are extracted, and the subtracted data is outputted as respective data of the first and the second frames. In the images which are visible by sequentially displaying the images of the first through third frames on the LCD 16, the density of the dot which is expressed by the image data $(1111)_2$ and that of the dot which is expressed by the image data $(1110)_2$ can be seen as different densities.

In addition, in a case in which the image data is $(0000)_2$, neither addition nor subtraction is effected, and $(000)_2$ is outputted as respective data of the first through third frames. In a case in which the least significant bit of the image data is 1 and all of the other bits are 0, i.e., $(0001)_2$, "1" is added to the data from which the high order three bits of the image data are extracted, and the added data is outputted as respective data of the first and the second frames. In the images which are visible by sequentially displaying the images of the first through third frames on the LCD 16, the density of the dot which is expressed by the image data $(0000)_2$ and that of the dot which is expressed by the image data $(0001)_2$ can be seen as different densities.

Moreover, in a case in which the image data is close to $(1000)_2$, that is, the output signal from the decoder 34 is high and within the range of $(0110)_2$ to $(1001)_2$, neither addition nor subtraction is effected to the second frame data because the output signal from the multiplexer 36 is low. Accordingly, when the image data increases from $(0110)_2$ to $(1001)_2$, the sum of the frame data of the first through third frames increases and becomes $(1001)_2$, $(1010)_2$, $(1011)_2$, and $(1100)_2$. The apparent densities change in accordance with the changes In the image data.

The sum of the frame data of the first through third frames always changes in the same direction as the changes in the image data (the sum increases when the image data increases). Therefore, even if the number of gradations which can be expressed on the LCD 16 is "8", in the images which are visible by sequentially displaying the image of the first through third frames on the LCD 16, the image is seen as if it were expressed by "16" gradations which are expressed by the 4-bit image data. In addition, when viewing each pixel, since the respective densities of each color R, G and B are expressed in 16 gradations, 4096 ($=16^3$) colors per pixel are apparently expressed. Therefore, even if the LCD 16 is inexpensive and can express only a small number of gradations, it can display images so as to accurately express the image which is represented by image data.

Further, in the above description, the LCD 16 is driven with a frame rate modulation cycle of three frames. As has already been explained in the operation, flickering of the image displayed on the LCD 16 does not become a problem, and a direct-current component is prevented from remaining in the driving voltage of the LCD 16.

Figure 5:
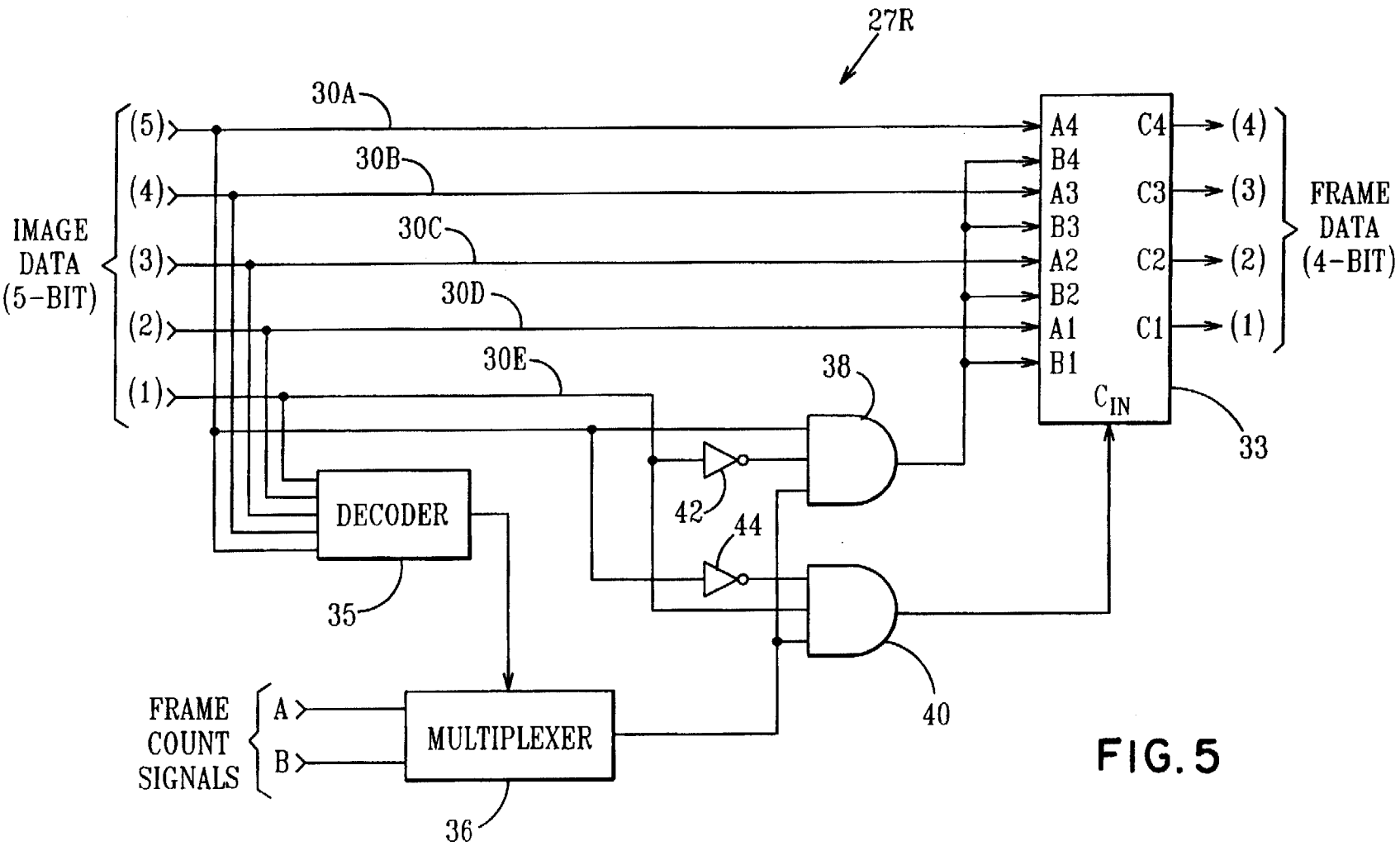
FIG. 5 is a circuit diagram showing another example of a structure of the frame rate modulation portion.

In the above description, an explanation is given of an example of conversion of image data, in which one dot is expressed by 4 bits, into a frame data, in which one dot is expressed by 3 bits. However, the present invention is not limited to the same. As an example, FIG. 5 shows the structure of a frame rate modulation portion which converts image data, in which one dot Is expressed by 5 bits, into frame data, in which one dot is expressed by 4 bits. A description will be given hereinafter of portions which are different from those of the frame rate modulation portion 26R in FIG. 3.

The frame rate modulation portion 27R in FIG. 5 includes five signal lines 30A, 30B, 30C, 30D, and 30E. 5-bit image data, which express one dot on the respective signal lines, are input in parallel. The signal lines 30A through 30D are connected to respective ones of the two input ends (i.e., are connected to input ends A4 through A1) of the 4-bit adder 33. Further, the signal lines 30A through 30E are respectively connected to the input ends of the decoder 35. In a case in which the 5-bit image data, which is inputted via the signal lines 30A through 30E, is within the range of $(01110)_2$ to $(10001)_2$, the decoder 35 outputs a high-level signal, and in a case in which the value of the 5-bit image data is outside of the above-described range, the decoder 35 outputs a low-level signal.

Moreover, among the three input ends of the AND circuit 38, one of the two input ends, which are not connected to the multiplexer 36, is connected to the signal line 30A, and the other is connected to the signal line 30E via the NOT circuit 42. Similarly, among the three input ends of the AND circuit 40, one of the two input ends, which are not connected to the multiplexer 36, is connected to the signal line 30A via the NOT circuit 44, and the other is connected to the signal line 30E. In addition, the output ends of the AND circuit 38 are connected to respective other ones of the two input ends (i.e., are connected to input ends B4 through B1) of a counter 33.

Table 3 shows a relationship, in the above-structured frame rate control portion 27R, between the inputted 5-bit image data (the first dot data) and the 4-bit frame data (the second dot data), which is outputted from the frame rate control portion 26 by the above-described operation.

TABLE 3

| image data | frame data (binary) | | |
|---|---|---|---|
| (binary) | first frame | second frame | third frame |
| 00000 | 0000 | 0000 | 0000 |
| 00001 | 0001 (+1) | 0001 (+1) | 0000 |
| 00010 | 0001 | 0001 | 0001 |
| 00011 | 0010 (+1) | 0010 (+1) | 0001 |
| 00100 | 0010 | 0010 | 0010 |
| 00101 | 0011 (+1) | 0011 (+1) | 0010 |
| 00110 | 0011 | 0011 | 0011 |
| 00111 | 0100 (+1) | 0100 (+1) | 0011 |
| 01000 | 0100 | 0100 | 0100 |
| 01001 | 0101 (+1) | 0101 (+1) | 0100 |
| 01010 | 0101 | 0101 | 0101 |
| 01011 | 0110 (+1) | 0110 (+1) | 0101 |
| 01100 | 0110 | 0110 | 0110 |
| 01101 | 0111 (+1) | 0111 (+1) | 0110 |
| 01110 | 0111 | 0111 | 0111 |
| 01111 | 1000 (+1) | 0111 | 0111 |
| 10000 | 0111 (−1) | 1000 | 1000 |
| 10001 | 1000 | 1000 | 1000 |
| 10010 | 1000 (−1) | 1000 (−1) | 1001 |
| 10011 | 1001 | 1001 | 1001 |
| 10100 | 1001 (−1) | 1001 (−1) | 1010 |
| 10101 | 1010 | 1010 | 1010 |
| 10110 | 1010 (−1) | 1010 (−1) | 1011 |
| 10111 | 1011 | 1011 | 1011 |
| 11000 | 1011 (−1) | 1011 (−1) | 1011 |
| 11001 | 1100 | 1011 | 1011 |
| 11010 | 1100 (−1) | 1100 (−1) | 1101 |
| 11011 | 1101 | 1101 | 1101 |
| 11100 | 1101 (−1) | 1101 (−1) | 1110 |
| 11101 | 1110 | 1110 | 1110 |
| 11110 | 1110 (−1) | 1110 (−1) | 1111 |
| 11111 | 1111 | 1111 | 1111 |

Consequently, even if the number of gradations which can be expressed on the LCD is "16", in the images which are visible by sequentially displaying the images of the first through third frames on the LCD, the image is seen as if it were expressed by "32" gradations which are expressed by the 5-bit Image data. In addition, when viewing each pixel, since the respective densities of R, G and B are expressed in 32 gradations, 32786 ($=32^3$) colors per pixel are apparently expressed.

Figure 3:
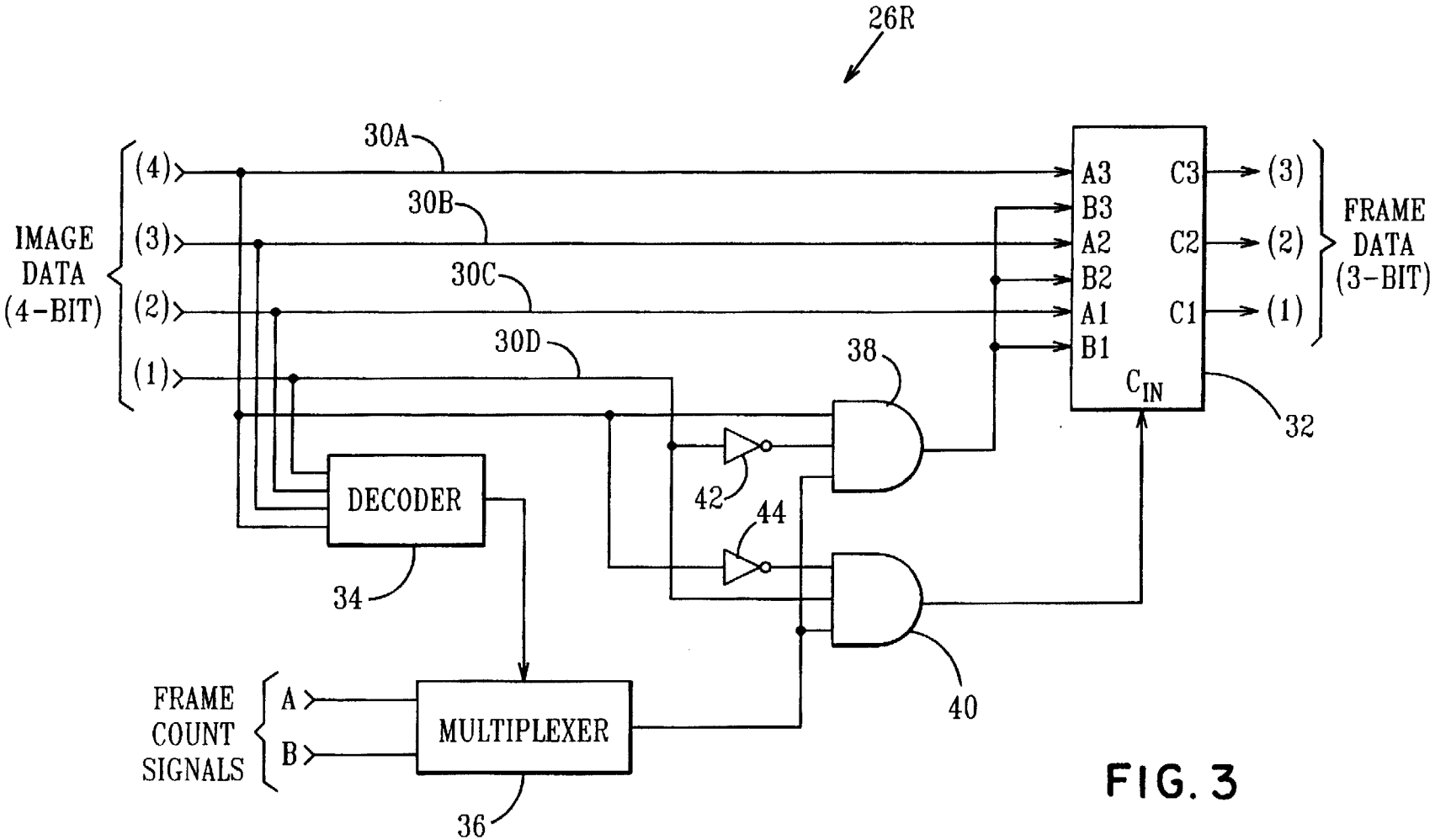
FIG. 3 is a circuit diagram showing a structure of a frame rate modulation portion.

Moreover, the structure of the frame rate modulation portion is not limited to the structure of FIG. 3. For example, the conversion relations which are shown in Tables 2 and 3 may be stored as lookup tables. Image data may be converted into frame data by referring to these lookup tables.

In the above description, a TFT-type LCD is used as an example of a display device. The present invention is not limited to the same and may be applied to an STN-type liquid crystal display, an MIN-type liquid crystal display or the like. The present invention can also be applied to a plasma display or the like.

In accordance with the present invention as described above, data, from which a least significant bit of the first dot data of the image data has been removed, is made into the respective second dot data of a plurality of frame data. In a case in which the least significant bit of the first dot data is 1 and the most significant bit is 0, 1 is added to a corresponding portion of the plurality of second dot data. In a case in which the least significant bit of the first dot data is 0 and the most significant bit is 1, 1 is subtracted from a corresponding portion of the plurality of second dot data. The image data is thereby converted into the plurality of frame data. Therefore, the present invention achieves a superior effect in that, even if a display device can express only a small number of gradations, the image can be displayed such that the image, which is represented by the image data, is expressed more precisely.

We claim:

1. A display device driving method in which image data, which expresses respective densities of dots by first dot data of a predetermined bit length, is converted into a plurality of frame data, which expresses respective densities of dots by second dot data which is shorter than said predetermined bit length, so as to drive a display device by said plurality of frame data, said display device driving method characterized by converting image data into a plurality of frame data by making data, from which a least significant bit of said first dot data has been removed, into said respective second dot data of said plurality of frame data, and in a case in which the least significant bit of said first dot data is 1 and a most significant bit is 0, adding 1 to a corresponding portion of said plurality of second dot data, and in a case in which the least significant bit of said first dot data is 0 and the most significant bit is 1, subtracting 1 from a corresponding portion of said plurality of second dot data, said plurality of frame data representing at least three successive frames of data.

2. A display device driving method according to claim 1, wherein in a case in which a difference between one of said first dot data and another one of said first dot data whose most significant bit is 1 and the other bits are 0 is small, a number of second dot data for which said addition or said subtraction is effected is decreased, and in a case in which said difference is large, the number of second dot data for which said addition or said subtraction is effected is increased.

3. A display device driving method according to claim 1, wherein a liquid-crystal display at which a thin-film transistor is provided in correspondence with respective dots is used as said display device.

4. A display device driving method according to claim 3, wherein image data is converted into three frame data.

* * * * *